US009134095B1

(12) United States Patent
Mills

(10) Patent No.: US 9,134,095 B1
(45) Date of Patent: Sep. 15, 2015

(54) VERTICALNESS INDICATING APPARATUS FOR USE WITH ARCHERY SIGHTS

(71) Applicant: Joseph D. Mills, Ridgefield, NJ (US)

(72) Inventor: Joseph D. Mills, Ridgefield, NJ (US)

( * ) Notice: Subject to any disclaimer, the term of this patent is extended or adjusted under 35 U.S.C. 154(b) by 0 days.

(21) Appl. No.: 14/689,584

(22) Filed: Apr. 17, 2015

Related U.S. Application Data

(60) Provisional application No. 62/052,229, filed on Sep. 18, 2014.

(51) Int. Cl.
*F41G 1/467* (2006.01)

(52) U.S. Cl.
CPC ..... *F41G 1/467* (2013.01)

(58) Field of Classification Search
CPC ..... F41G 1/467; F41G 1/345; F41G 1/44
USPC ..... 33/265; 124/87
See application file for complete search history.

(56) References Cited

U.S. PATENT DOCUMENTS

| | | | | | |
|---|---|---|---|---|---|
| 4,325,190 | A * | 4/1982 | Duerst | 33/265 |
| 4,400,887 | A * | 8/1983 | Mason | 33/265 |
| 4,711,036 | A * | 12/1987 | Morris | 33/265 |
| 4,894,921 | A * | 1/1990 | Barlow | 33/265 |
| 5,367,780 | A * | 11/1994 | Savage | 33/265 |
| 5,524,351 | A * | 6/1996 | Pinson et al. | 33/265 |
| 5,634,278 | A * | 6/1997 | London | 42/132 |
| 6,199,286 | B1 * | 3/2001 | Reed et al. | 33/265 |
| 7,069,662 | B2 * | 7/2006 | Fung et al. | 33/334 |
| 7,162,806 | B1 * | 1/2007 | Swiggart | 33/265 |
| 7,275,328 | B1 | 10/2007 | Rager | |
| 7,296,358 | B1 * | 11/2007 | Murphy et al. | 33/265 |
| 7,412,771 | B2 | 8/2008 | Bradley et al. | |
| 7,487,594 | B2 * | 2/2009 | Labowski | 33/265 |
| 7,578,067 | B2 * | 8/2009 | Rager | 33/265 |
| 7,698,824 | B2 | 4/2010 | Wilson | |
| 7,921,570 | B1 | 4/2011 | Pulkrabek et al. | |
| 8,006,395 | B2 | 8/2011 | Kingsbury | |
| 8,171,648 | B2 | 5/2012 | Summer et al. | |
| 8,186,068 | B2 | 5/2012 | Pulkrabek et al. | |
| 8,272,137 | B2 | 9/2012 | Logsdon | |
| 8,276,282 | B2 | 10/2012 | Mainsonneuve et al. | |
| 8,316,551 | B2 | 11/2012 | Gorsuch et al. | |
| 8,661,696 | B2 | 3/2014 | Pulkrabek et al. | |

* cited by examiner

*Primary Examiner* — Christopher Fulton
(74) *Attorney, Agent, or Firm* — Paul Diamond, Esq.; Diamond Law Office, LLC

(57) ABSTRACT

The invention provides a verticalness indicating apparatus for a bow in which the axial position of a pendulum member with respect to the housing in which the pendulum is mounted controls one or both of the color and intensity of light delivered via a light guide from the apparatus to one or more sight pins of a bow sight mounted on the bow. In this manner, the apparatus provides visual cues to the archer as to the vertical alignment of the bow contemporaneously with the archer's focus on the sight pin.

14 Claims, 11 Drawing Sheets

Purple

Green

White

Red

Purple

VERTICALNESS INDICATING APPARATUS FOR USE WITH ARCHERY SIGHTS

CROSS-REFERENCE TO RELATED APPLICATIONS

This application claims the benefit of U.S. provisional application Ser. No. 62/052,229 filed Sep. 18, 2014, which is hereby incorporated by reference in its entirety.

FIELD OF THE INVENTION

The invention relates to the field of archery bow sights.

BACKGROUND

One of the many hurdles an archer must overcome to hit a target is to have the bow remain level (vertically upright) while aiming. All archers want their arrows to travel such that the arrow hits the center of the target and the verticalness of the bow is critical to obtaining this goal. Indeed, with a misaligned (off-vertical) standard bow, a ¼-inch (approx. 6.5 mm) tilt translates to a 10-inch (approx. 25.4 cm) miss at 40 yards (approx. 36.6 meters), with the extent of the miss increasing dramatically the further down range the arrow travels toward the target.

Nearly all modern bow sights share three features. They will have some type of fiber optic sight pin or pins that can be adjusted up, down, left or right to align the bow, on target, so that when an arrow is shot correctly and the pin is on the center of the target, the arrow travels and hits the center of the target. Various aspects of conventional fiber optic pin sights used in archery and their manufacture are described, for example, in U.S. Pat. No. 8,171,648 which is incorporated by reference herein in its entirety. Bow sights may also have a bubble level attached somewhere on the sight, most often to the pin guard housing, which surrounds and protects the pins from damage. The bubble level typically will be mounted so that its longitudinal axis is horizontal and at a 90-degree angle to the upright vertical axis of the bow itself. In this manner, an indication by the level of levelness similarly indicates the verticalness/tilt of the bow. If a bow leans to the right, the arrow will travel to the right, if the bow leans to the left, the arrow will travel to the left. The more the archer leans the bow, the further off target the arrow travels.

Once the bow string and arrow are pulled back to a preset draw weight and length set for a particular archer's physicality and dimensions, the archer then starts to visually align the pin of choice on the target. Then, the archer's focus is drawn away from the pin, to the level, once the archer believes that the level is aligned, the archer's attention then, shifts back to the pin, then to the pin on the center of the target, while hoping that the bow remains level. Although the pin and level are near to each other in proximity, the archer has to mentally shift his/her attention back and forth. Some sights even add a second, more defined level, adding even more steps to the aiming process and shifting the archer's focus even more.

What is needed and provided by the present invention are improved verticalness-indicating apparatuses and bow sights that eliminate the need for an archer to shift their attention between the sight's aiming point(s) and its levelness indicator(s), thereby improving the user's accuracy, speed and overall performance.

SUMMARY OF THE INVENTION

One embodiment of the invention provides a verticalness indicating apparatus that includes:

a back side, a front side, a left side and a right side;

a pendulum member having a back side, a front side, and an expansive dimension in a plane transverse to a front-back direction, the pendulum pivotally suspended in a left-right direction;

a light source disposed on the front side or the back side of the pendulum;

a light guide having a proximal end and a distal end, the proximal end of the light guide disposed on the opposite side of the pendulum as the light source, the pendulum being interposed between the light source and the proximal end of the light guide, wherein the position of the light source and the position of the proximal end of the light guide are static with respect to each other, and wherein the pendulum is configured to control one or both of the amount of light and the color of light received into the proximal end of the light guide after originating from the light source based on the axial tilt of the apparatus in the plane transverse to the front-back direction.

Another embodiment of the invention provides a verticalness indicating apparatus that includes:

a back side, a front side, a left side and a right side a pendulum member having a back side, a front side, and an expansive dimension in a plane transverse to a front-back direction, the pendulum pivotally suspended in a left-right direction;

a light source disposed on front side or the back side of the pendulum;

a plurality of linearly aligned, vertically separated light guides each having a proximal end and a distal end, the proximal end of each light guide disposed on the opposite side of the pendulum as the light source, the pendulum being interposed between the light source and the proximal ends of the light guides, a movable selector member sized and configured to permit light from the light source to pass at least substantially only into the proximal end of a selected one of the plurality of linearly aligned, vertically separated light guides, wherein the position of the light source and the position of the proximal end of the light guide are static with respect to each other, and wherein the pendulum is configured to control one or both of the amount of light and the color of light received into the proximal end of the selected light guide after originating from the light source based on the axial tilt of the apparatus in the plane transverse to the front back direction.

A further embodiment of the invention provides a verticalness indicating apparatus that includes:

a back side, a front side, a left side and a right side a light transmission controlling member having a back side, a front side, and an expansive dimension in a plane transverse to a front-back direction, the light transmission controlling member movable in a left-right direction in relation to the axial tilt of the apparatus in plane transverse to the front-back direction;

a light source disposed on the front side or the back side of the light transmission controlling member;

a light guide having a proximal end and a distal end, the proximal end of the light guide disposed on the opposite side of the light transmission controlling member as the light source, the light controlling member being interposed between the light source and the proximal end of the light guide, wherein the position of the light source and the position of the proximal end of the light guide are static with respect to each other, and wherein the light transmission controlling member is configured to control one or both of the amount of light and the color of light received into the proximal end of the light guide after originating from the light source based on the axial tilt of the apparatus in the plane transverse to the front back direction.

The invention also provides related assemblages that include an aiming sight, such as archery aiming sight, such as one that includes a pin surround member (pin guard, ring, tube, etc., that may have a circular profile) and at least one sight pin extending into the space bounded by the pin surround member and a verticalness indicating apparatus embodiment of the invention operably connected to the aiming sight. The invention still further provides assemblages that include a ballistic device such as an archery bow, a crossbow, or a firearm such as a rifle or a pistol, having mounted thereon, as a unit or as distinct components, an aiming sight and a verticalness indicating apparatus embodiment of the invention operably connected to a pin sight of the aiming sight.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE DRAWINGS

FIG. 8A is a side view. FIG. 8B is a front (target side) view. FIG. 8C is a back (archer side) view.

DETAILED DESCRIPTION OF THE INVENTION

Figures 1A, 1B:
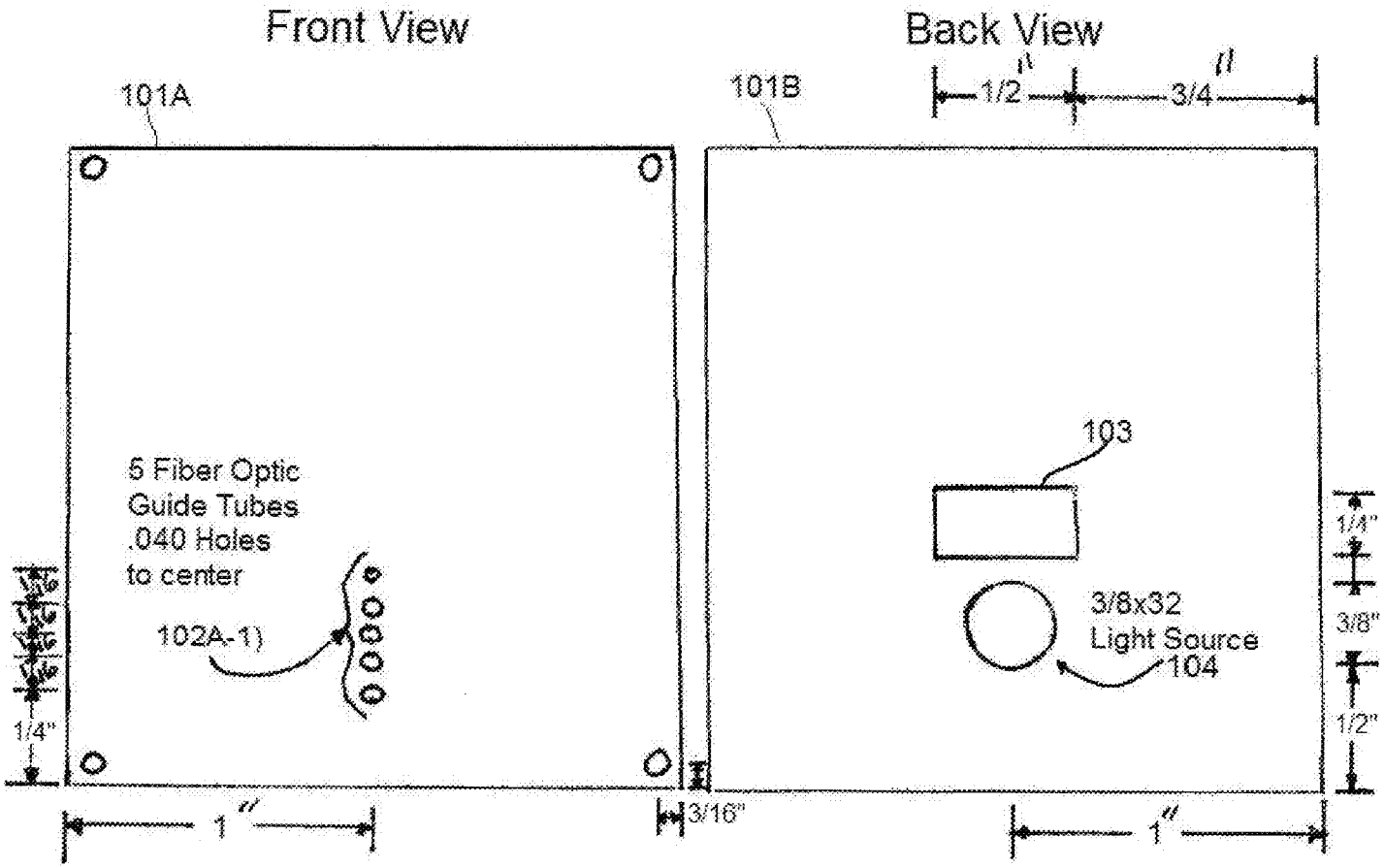
FIG. 1A shows the front (target side) view of the housing of a verticalness-indicating device embodiment of the invention.
FIG. 1B shows the back (archer side) view of the housing of the verticalness-indicating device embodiment shown in FIG. 1A.

In one aspect, the invention provides vertical orientation indicating apparatuses for bows in which the position of a pendulum member configured to freely swing in a left-right direction with respect to the vertical axis of the apparatus controls one or both of the color and intensity of light delivered via a light guide from the apparatus to one or more aiming pins (sight pins) of a bow sight mounted to the bow. In this manner, the apparatuses provide visual cues to the archer as to the vertical alignment of the bow contemporaneously with the archer's focus on the aiming pin.

In contrast to a conventional bow sight in which the archer's eyesight and attention must switch from an aiming pin to one or more bubble levels mounted horizontally on the sight to provide an indication of the bows vertical alignment, with the present invention, the archer only has to focus on the pin/selected-pin and the target, with the light emanating from the pin indicating the vertical alignment of the bow. For example, the apparatus may be configured so that the brightest intensity and/or a pre-selected color emanating from the pin signifies that the bow is vertical, i.e., zero degrees from vertical or whichever degree variation from zero degrees is selected by the archer according to their preference. Thus, the present invention eliminates at least two steps involved in the aiming process of conventional bow sights as well as the need for and time involved in redirecting one's eyesight and attention from an aiming pin to a bubble level, thereby considerably shortening the time required to build one's shot. The invention also eliminates the problem of visually losing the bubble level or pin in low light settings.

One embodiment of the invention provides a verticalness/levelness indicating apparatus including a pendulum member that includes multiple color filter areas/components that differently interrupt a beam of light according to the axial tilt of the apparatus. The apparatus may, for example, be employed with standard, readily available, fiber optic archery sights and light sources, to turn the sight pin, itself, into a defined visual indicator of verticalness/levelness. Such a pendulum may be encased in a small housing that is integrated with or mounted to a bow sight. Inside the housing, the pendulum is disposed between the end of a light guide that delivers light to the pin (such as a fiber optic light guide) and a light source. An opaque covering may cover the light guide so that no other light source can project a random color or brightness to the pin. When the bow is at true level (vertically upright), a 0.010 inch (approx. 0.25 mm) through-hole formed in the pendulum is aligned in the front-back direction with the light source transmitting a higher intensity white light (or whichever color light source the archer has chosen to supply light to the pin)

directly to the light guide on the other side of the pendulum, transmitting this light directly to the pin thereby indicating to the archer that the bow has achieved true level. As the bow is tilted off-vertical (clockwise or counterclockwise), the light-path between the light source and the proximal end of the light guide is interrupted with color filter areas of the pendulum, thereby effecting not only the intensity of light (which is highest at true vertical when the light path is aligned with the through hole in the pendulum and lower when passing through the filter areas) but also the color of light transmitted to the point of the pin sight. The color filter area to the left of the through-hole in the pendulum and that to the right of the through-hole may be different colors so that an indication of clockwise or counterclockwise off-vertical tilt is instantly transmitted to the archer via the pin sight.

The problem eliminated by the present invention is that, under pressure, the archer's attention is shifted between the pin to the level or levels and back to the target and pin. Although the pin and level are near to each other, the archer has to mentally shift his/her attention back and forth. Some sights even add a second more defined level, adding even more steps to the aiming process and shifting the archer's focus even more. The longer the bow is held at draw, it can creep out of level left or right and usually does, ruining the shot. As the archer shifts attention back and forth from the pin to the level or levels, and back to target and pin, while under pressure, takes time and strength while holding the bow at full draw weight. The more steps involved and the longer the aiming process takes while under pressure, the longer the archer must maintain form. Thus, the archer becomes weaker, mentally and physically and starts to shake as muscles become fatigued and the shot falls apart. The invention eliminates the splitting of the archer's focus and also eliminates an extra step in the aiming process, ultimately shortening the time needed to aim the bow and resulting in an easily aligned shot with true verticalness. Further advantageously, the invention eliminates the problem encountered in low light situations in which an archer can lose sight of his/her level and even the aiming pin itself. The bubble of a bubble level and its position can also become difficult to see in bright sunlight while the optical signal(s) provided by the invention remain clearly visible under this condition. Still further advantageously, the invention acts a visual clicker providing the archer with a definitive signal to shoot. Archers currently use an audible clicker to alert the archer when to commit to a shot, triggering the loose of the arrow. When the archer's focus is drawn away to operate the loose of the arrow, this costs the archer the aiming of the bow on target, resulting is a poor shot. With the present invention, the archer can remain immersed in the aiming of the pin with his/her mental focus not being drawn away from the pin to operate the loose of the arrow.

In one aspect, the present invention permits the archer to have the pin focused on the center of the target, with the bow, slightly askew, and as the bow is rolled slightly into true level, the pin will illuminate brightly, signaling the loose of the arrow.

Various aspects of the invention and its embodiments are further described below with respect to the appended drawings.

FIGS. 1A and 1B depict the outside of a vertical orientation-indicating device embodiment of the invention in its housing. FIG. 1A shows a front view 101A of the housing, which is the target side of the device in this example. Four holes, one at each corner are formed to insert M3 0.5×1⅞ inch (3 mm diameter external thread, thread every 0.5 mm, approx. 4.76 cm long) bolts to secure the front and back halves of the housing to each other. In the middle lower half are five 0.040 inch (approx. 1 mm) holes 102 for receiving an optical fiber light guide into the device (depending on the application, any unnecessary hole can receive a plug instead of a fiber optic material and similarly the device may be manufactured with only one hole/passage for a single light guide). In general, there must be at least one hole through the device housing for the light guide to pass from a sight pin of a sight having at least one sight pin into the inside of the housing but the device may have a plurality of holes, such as 2-7, for a plurality of light guides to optically connect to a corresponding plurality of sight pins of a multi-pin sight. The optical fiber light guide may include one or more optical fibers, such as an optical fiber bundle, and may be clad in a protective sheath or coating which may be opaque to keep out stray light, such as a flexible polymer sheath or coating which may be opaque. FIG. 1B shows a back (archer side) view 101B of the device housing, with a prism 103 mounted into a recessed port in the lower half, the prism in optical communication with the inside of the device housing so that ambient light can be delivered from the outside to the inside of the housing via the prism. The prism is selected to redirect light not split light into its component parts. A mirror may, for example, be used instead of a prism. Below the prism is a threaded hole 104 of ⅜ inch×32 (⅜ inch (approx. 9.5 mm) major diameter, 32 threads per inch (per approx. 9.53 mm)) for receiving a light source, such as a battery-operated rheostat-controlled white light LED light source as known in the art. The embodiment shown has both a prism and a threaded hole traversing the housing wall for receiving a light source. However, an apparatus according to the invention may have one or the other, and/or may have a fully internal light source.

Figure 2:
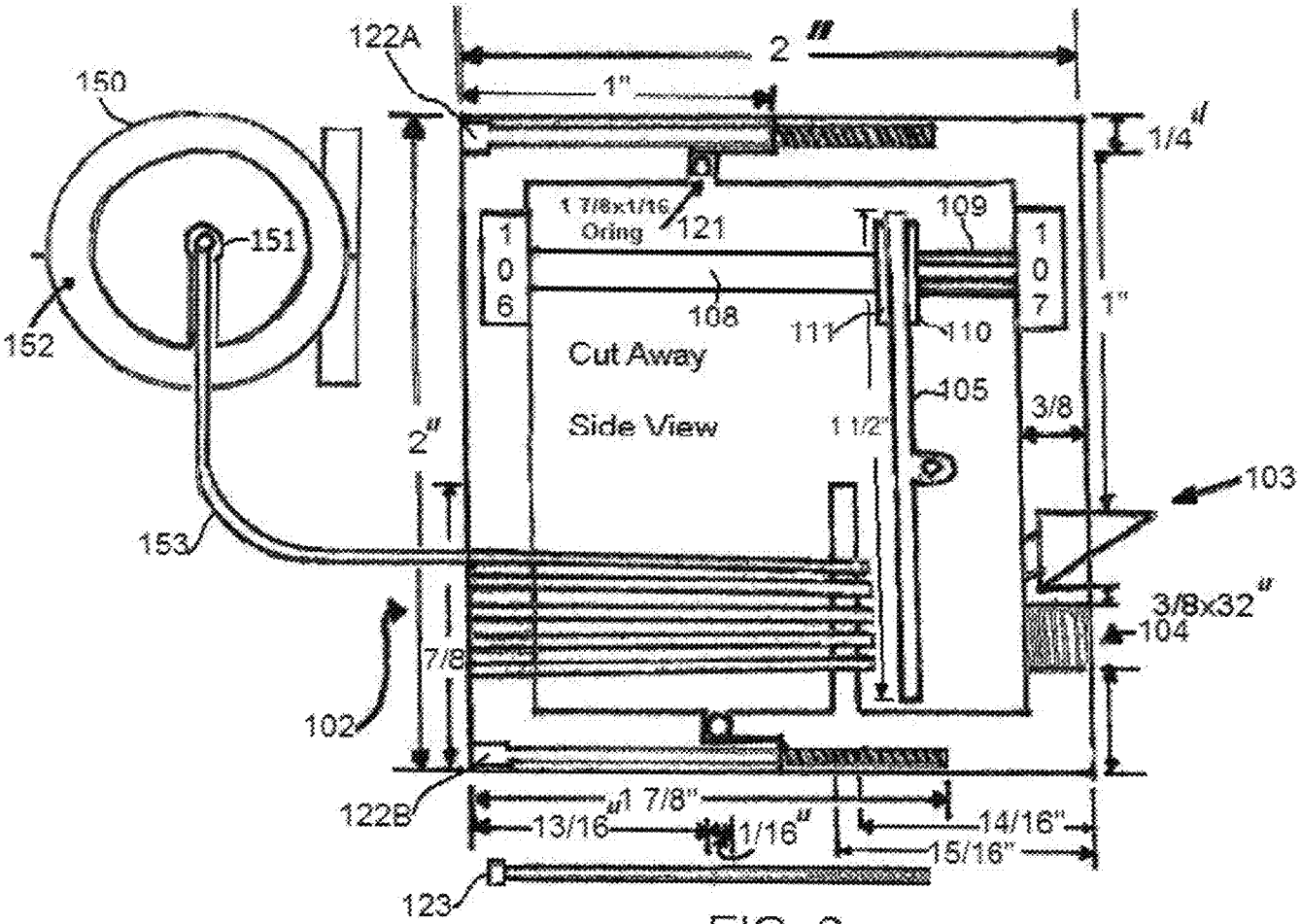
FIG. 2 is a schematic diagram showing a side, cut-away view of the verticalness-indicating device embodiment of FIGS. 1A and 1B and its connection to the sight pin of a bow sight. The front side (target side) is on the left and the back side (archer side) is on the right in this example. The sight pin assembly is schematically shown off its operable front-back axis, for the sake of illustration only.

FIG. 2 is a schematic diagram showing a side, cut-away view of the vertical orientation-indicating device embodiment of FIGS. 1A and 1B and its connection to the sight pin of a bow sight. Depicted in the upper left hand corner of the drawing is an example of a standard single pin archery sight 150 (including a sight pin 151 and a pin surround 152) that would face the archer, but which is shown off-axis here solely to illustrate how the light guide 153 is routed from pin 151 into the device. This cut away half section shows how the light guide 153 is routed from the sight pin into the device where it receives light that passes from a light source (103 or 104) through an at least substantially flat pendulum member 105. Pendulum 105 may include spatially segregated transparent color filter areas and/or non-color filtered (clear) transparent areas and/or one or more holes formed there-through which areas or holes are differentially interposed between the light source and the near end of the light guide as the position of the pendulum and the vertical axis of the bow move with respect to each other. Also shown is a cut-in-half side view of a 1⅞ inch (approx. 4.76 cm) rubber O-ring seal 121, disposed between the front and back halves of the device housing, recessed into a shelf. Further shown are the bearings, 106 and 107, mounted and recessed into the front and back halves of the device, the axle 108 and sleeve 109 that sit inside the two bearings and the two 1/16 inch (approx. 1.59 mm) ID (inner diameter) circular washers, 110 and 111, that sandwich the indicator pendulum between them and the 1/16 inch (approx. 1.59 mm) ID 1 inch (approx. 2.54 cm) long sleeve 109 that compress the washers and indicator pendulum 105 together and fit into the bearings. Still further shown are the mounting positions of both the prism 103 and a standard rheostat light source 104, as well as the screw holes 122A and 122B for 1⅞ inch (approx. 4.76 cm) long M3 0.5×1⅞ inch Allen screws 123 which hold both halves together.

Figure 3:
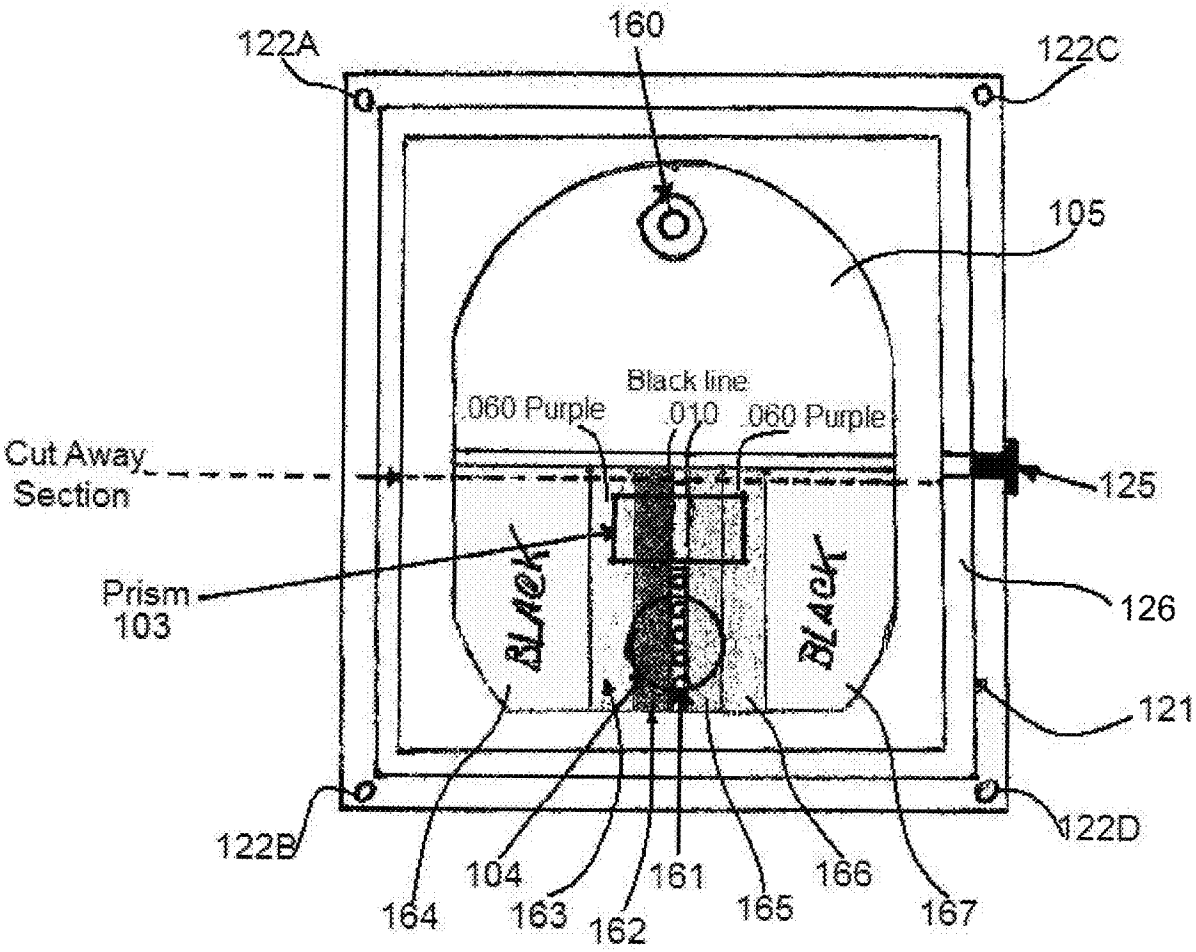
FIG. 3 is schematic diagram showing a back (archer side) open view of the verticalness-indicating device embodiment of FIG. 2 and illustrating, among other things, the multi-color pendulum member of the apparatus.

FIG. 3 is a cut-away, back (archer side) view of the device showing the mounted multi-color indicator pendulum 105 and its pivot point 160, the mounting position of both the prism 103 and LED light source 104, and the position of the pendulum balance adjustment access port and ⅛ inch (approx. 3.18 mm) rubber plug 125 disposed in it. Also shown are the back half of the shelf 126 that presses against rubber O-ring 121 that seals the device and the screw holes 122A-D for the M3 0.5×1⅞" Allen screws that join the front and back halves of the device together. The dotted line across the middle of the cut-away section depicts the height and position of the final mount that receives the light guide(s). A series of five vertically separated holes 161 are formed at the plumb line (midline as shown) of pendulum 105. To the left of the midline is a vertical red optical filter band 162, followed further to the left by a vertical purple optical filter band 163, followed still further to the left by an opaque area 164 that may be black. To the right of the midline is a vertical green optical filter band 165, followed further to the right by a vertical purple optical filter band 166, followed still further to the left by an opaque area 167 that may be black. Very thin, opaque lines, for example, black lines, may separate the filter band areas from each other.

Figure 4:
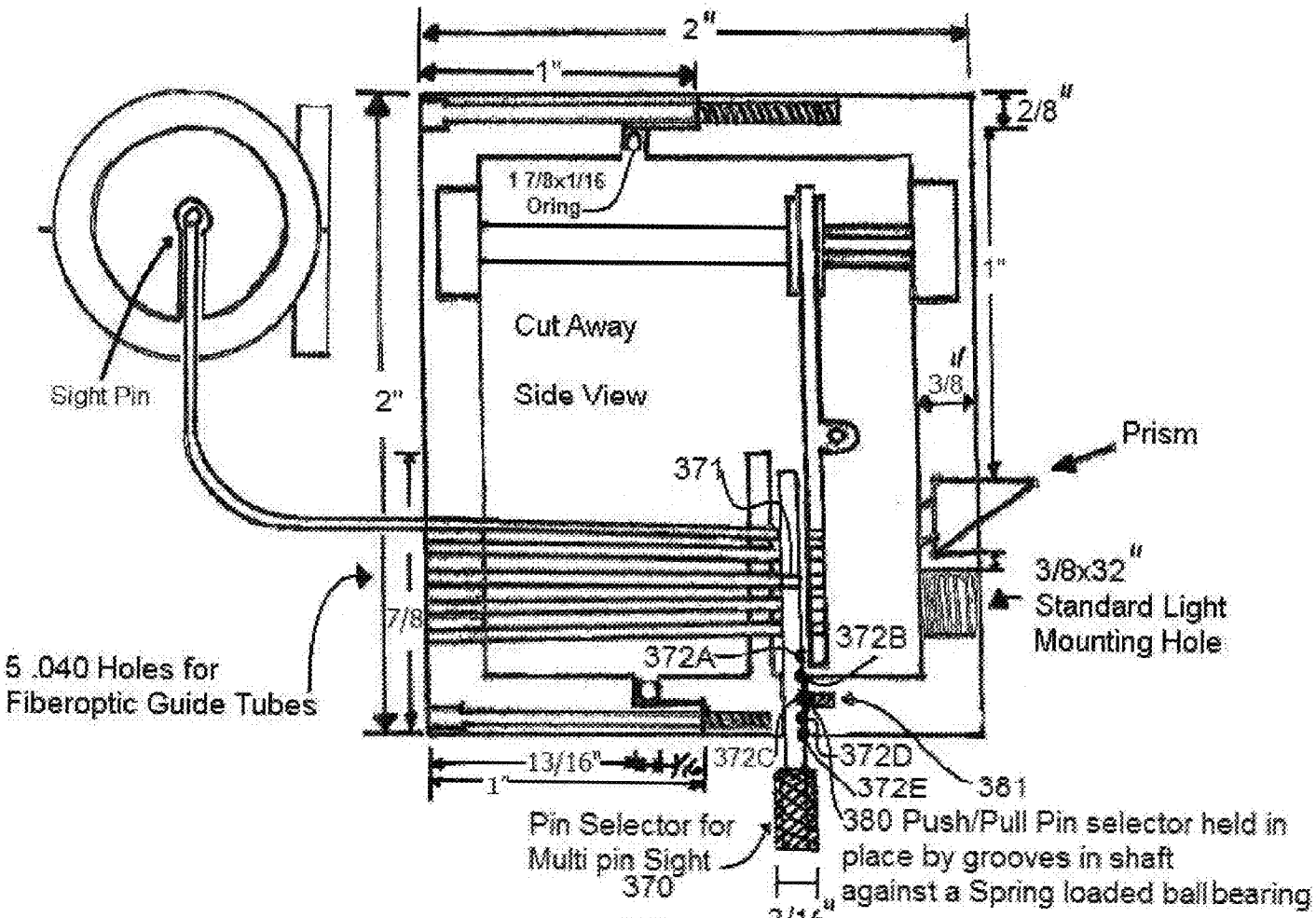
FIG. 4 is a schematic diagram showing a side, cut-away view of a verticalness-indicating device embodiment and its connection to the sight pin of a bow sight similar to that of the embodiment shown in FIG. 2 but having a vertically movable pin-selecting member. The front side (target side) is on the left and the back side (archer side) is on the right. The sight pin assembly is schematically shown off its operable front-back access, for the sake of illustration only.

FIG. 4 is a schematic diagram showing a side, cut-away view of the vertical orientation (verticalness)-indicating device embodiment and its connection to the sight pin of a bow sight similar to that of the embodiment shown in FIG. 2 but having a vertically movable pin-selecting member. FIG. 4 is similar to FIG. 2, except that FIG. 4 further includes a movable pin selector 370 for use with multi-pin sights (for simplicity, however, the illustrated pin sight of the figure shows only one pin and the light guide connected to it). The rod-like pin selector slides up and down in a square hole when the knurled knob at the bottom is pulled or pushed. Selector 370 blocks light from entering all the fiber optic material except in the position of a single hole 371 formed through the body of the selector. Instead of an actual hole, the pin-selector could have a transparent portion, for example, having the same position and dimensions as the hole. As shown, the pin selector can be moved to each of five positions. There is a 1/16 inch (approx. 1.59 mm) ball bearing 380 recessed into a ¼ inch (approx. 6.35 mm) long horizontal hole which contains a spring 381 which pressures the ball bearing to intersect the optional pin selector into one of the five index holes 372A-E (partial, not through-holes) drilled into the selector, the five index holes corresponding to the five positions of the mounted guide tube holes. Each pin of the multiple pin sight may be connected to a light guide that may be selected by the pin selector.

The pin selector allows the same color (same color illumination) to be used for the different aiming pins (sight pins) used for different distances since only the particular pin selected, for a specific distance, will be illuminated. Thus, use of the pin selector eliminates the need for different colored (illuminated in different color) pins to distinguish between the pins used for aiming at targets at different distances. Furthermore, it is well recognized that some color pins, such as orange and yellow are more difficult for an archer to see against a target, than others. By selectively illuminating only the desired pin using the pin selector, there is no need to include colors that are not the most distinguishable. In fact, bright white illumination may be used.

Figure 5:
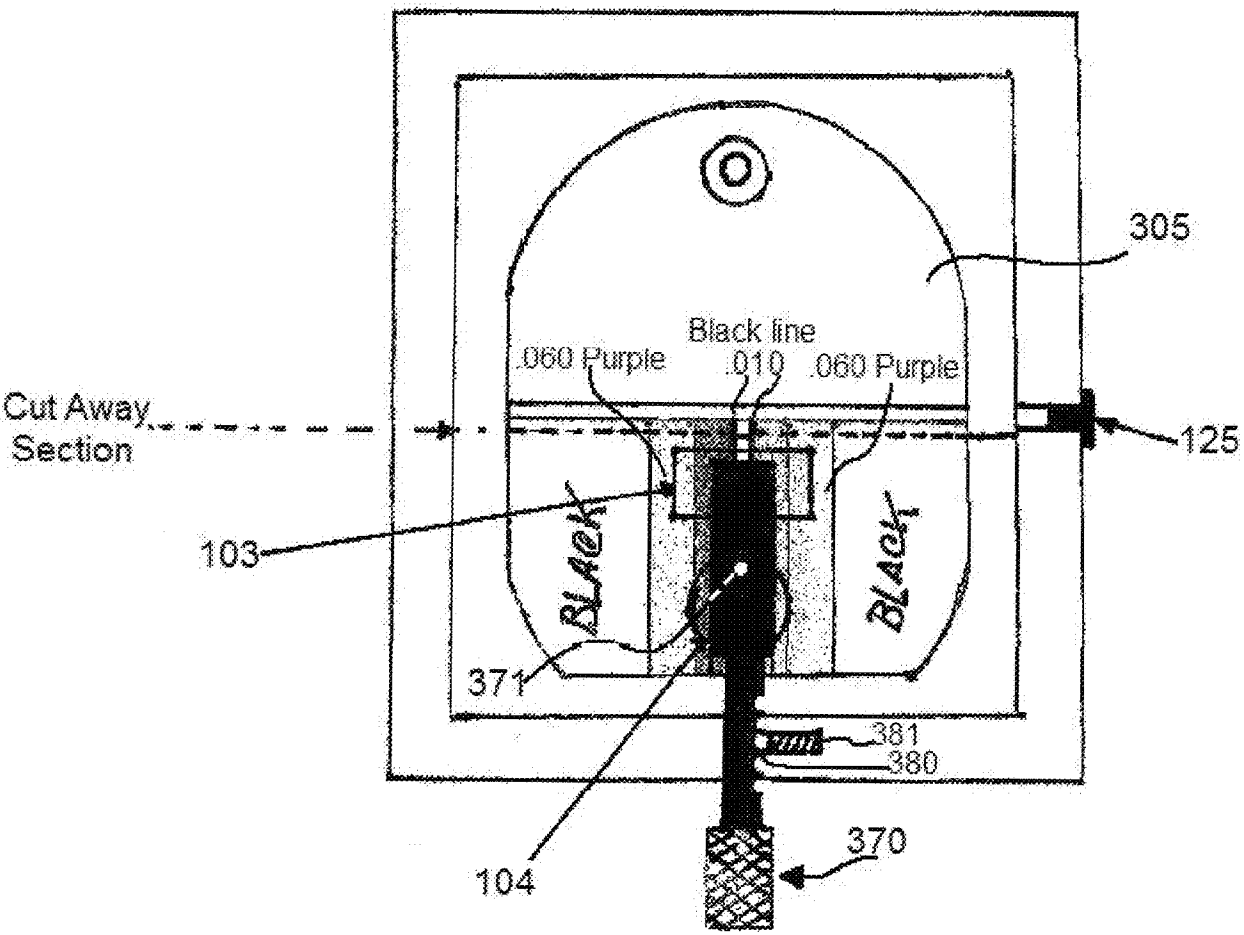
FIG. 5 is a schematic diagram showing a back (archer side) open view of the verticalness-indicating device embodiment of FIG. 4 and illustrating, among other things, the multi-color pendulum member of the device and the position of the pin-selecting member.

FIG. 5 is schematic diagram showing a back (archer side) open view of the vertical orientation (verticalness)-indicating device embodiment of FIG. 4 and illustrating, among other things, the multiple color filter pendulum member of the device and the position of the pin-selecting member. The view shown in FIG. 5 is similar to that shown in FIG. 3, except that FIG. 5 shows pin selector 370 with its front-to-back through-hole 371 for passing light from the light source to one of the light guides (each optically connected to a sight pin), said passage of light controlled by the interposed light transmission controlling pendulum 305, and the ball bearing indexes for the five vertical positions of the selector that correspond to the five positions of the light guides (their proximal ends) on the other side of the pendulum.

Figure 6D:
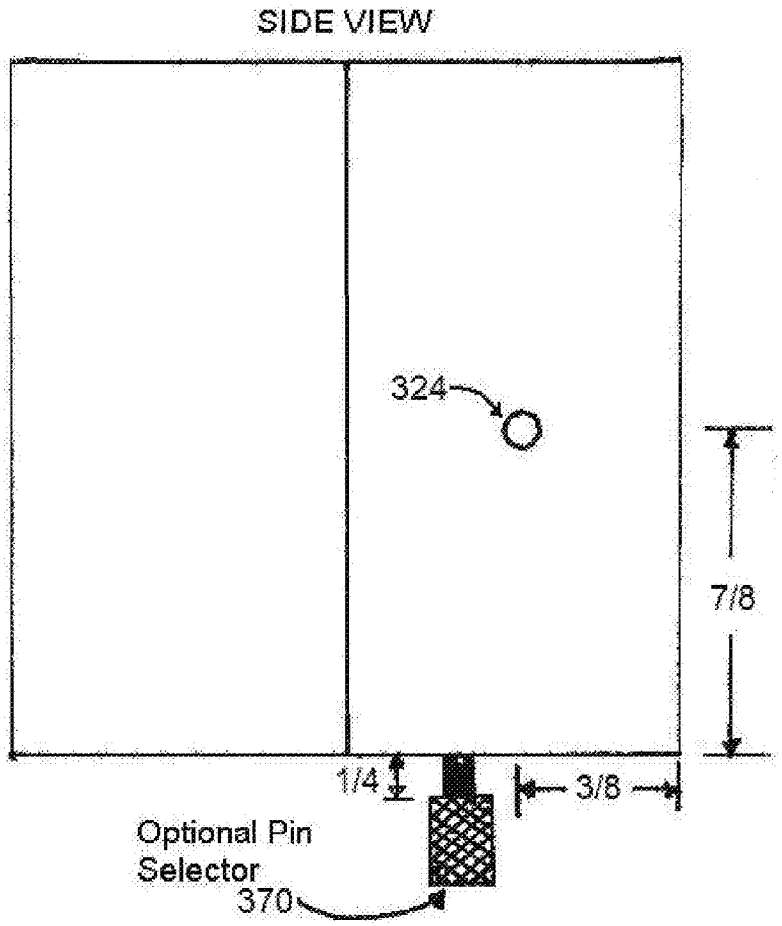
FIGS. 6A-E show in more detail the components of the pin-selecting mechanism of the embodiment shown in FIGS. 4-5.
Figure 6B:
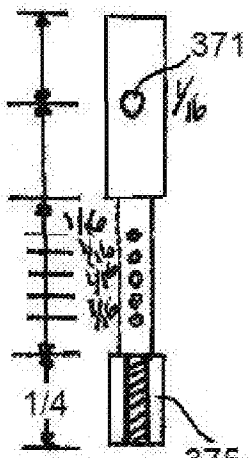
Figure 6C:
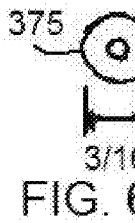
Figure 6A:
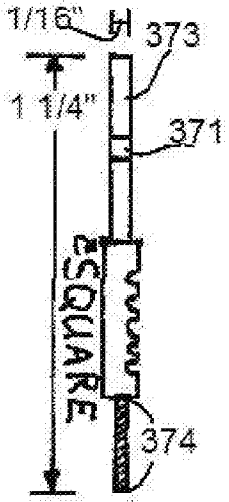
Figure 6E:
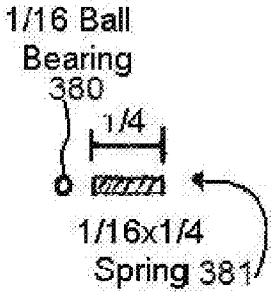

FIGS. 6A-E show in more detail the components of the pin-selecting mechanism of the embodiment shown in FIGS. 4-5. FIG. 6A shows a side view of the multi pin selector shaft, its square body with the five index holes that ride up and down against the ball bearing that is spring loaded for pressure and only allows light to enter one of the five pins mounted to the device, these index indentations correspond to five guide tube holes that transmit the light to the pins, and the bottom end 374 of the shaft that is threaded to M3 0.5×¼ inch (approx. 6.36 mm long) that accepts the knurled knob 375. FIG. 6B shows the front view of pin selector 370 with the knurled knob 375 installed and the five index holes. FIG. 6C shows the top view of the knurled knob of the pin selector which has a tapped M3 0.5×1/16 inch (approx. 1.59 mm) hole in the center. FIG. 6D shows a side view the front and back halves of the device joined together and also shows the position of the pendulum balance adjustment access port 324 (that can be sealed with a rubber plug when not in use) and pin selector 370. FIG. 6E shows the 1/16 inch (approx. 1.59 mm) ball bearing 380 and the 1/16 inch (approx. 1.59 mm) wide×¼ inch (approx. 6.35 mm) long spring 381 for the pin selector. The side of the pin selector may optionally be labeled or otherwise marked to distinguish each particular index corresponding to the different yardages. The pin selector may, for example, be manufactured by machining one or more metal stock pieces.

Figure 7A:
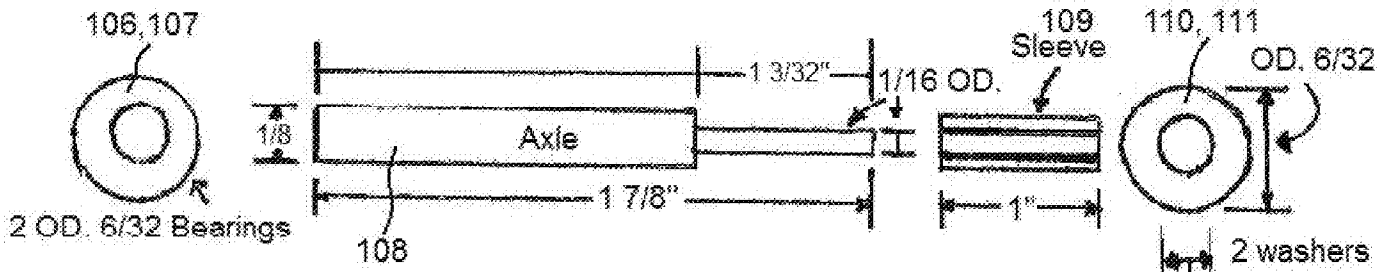
FIG. 7A shows an exploded view of the pendulum support components that pivotally support the indicator pendulum of the embodiments shown in the figures and FIG. 7B shows said components assembled with the indicator pendulum pivotally supported thereby.
Figure 7B:
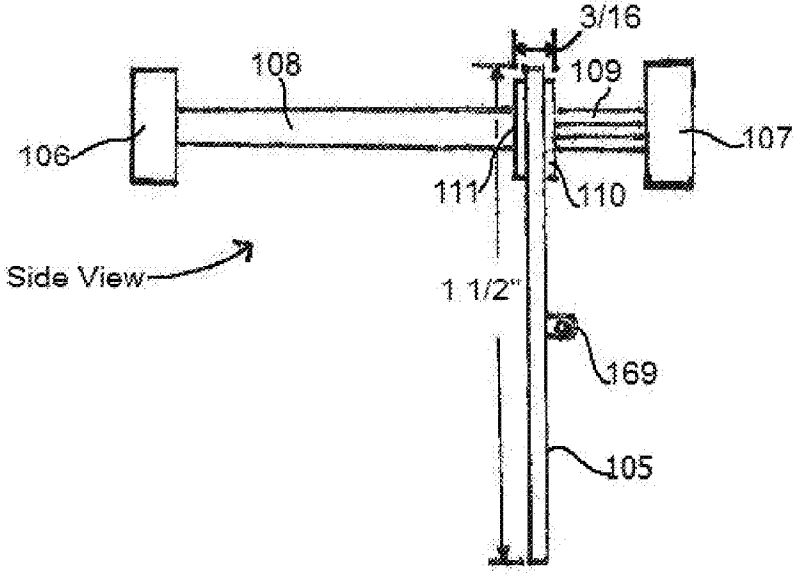

FIG. 7A shows an exploded view of the pendulum support components that pivotally support the indicator pendulum of the embodiments shown in the figures and FIG. 7B shows said components assembled with the indicator pendulum pivotally supported thereby. FIG. 7A illustrates the two 6/32 (3/16) inch (approx. 4.76 mm) OD (outer diameter) ⅛ inch (approx. 3.18 mm) ID bearings 106 and 107, the ⅛ inch (approx. 3.18 mm) OD 1⅞ inch (approx. 4.76 cm) long axle 108 that is stepped down 13/32 inch (approx. 10.32 mm) from the end to 1/16 inch (approx. 1.59 mm) ID, a 1 inch (approx. 2.54 cm) long sleeve 109 with ⅛ inch (approx. 3.18 mm) OD and 1/16 inch (approx. 1.59 mm) ID, and the two 1/16 inch (approx. 1.59 mm) wide washers 110 and 111 with OD 6/32 (3/16) inch (approx. 4.76 mm) ID 1/16 inch (approx. 1.59 mm) which sandwich the light transmission controlling pendulum between the two washers. FIG. 7B shows the assembled view of said components with pivotally mounted pendulum 105 having a set screw mount 169 that has a left-right oriented threaded screw hole for receiving a set screw for adjusting the center of mass of the pendulum.

Figures 8A, 8B, 8C:
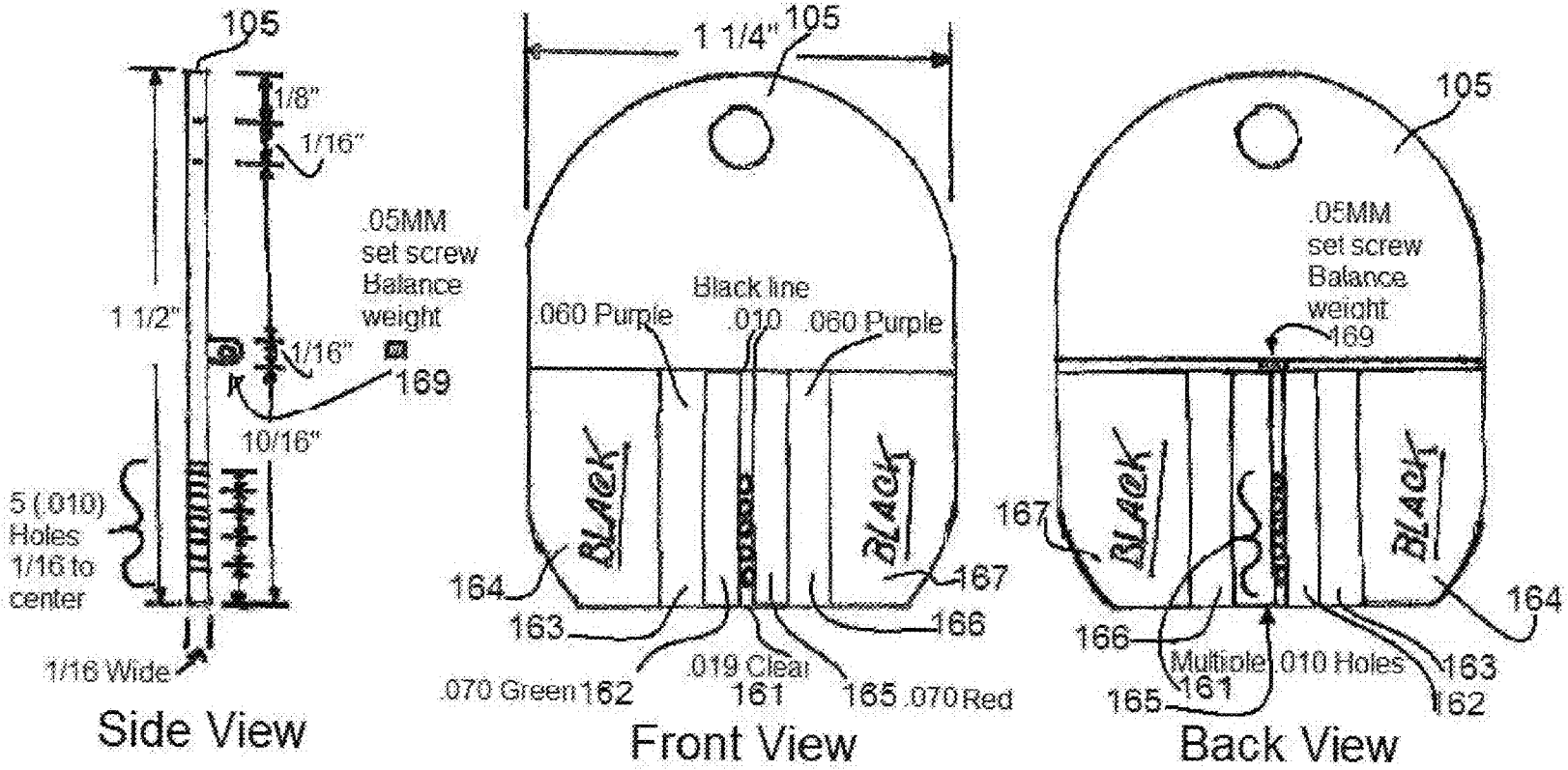
FIGS. 8A-C show different views and detail of a multi-color indicator pendulum embodiment of the invention that may be used in the verticalness-indicating device embodiments of the invention.

FIGS. 8A-C show different views and detail of a multiple color filter area indicator pendulum embodiment of the invention (laid out in the same manner as the pendulum shown in FIG. 3) that may be used in the verticalness-indicating device embodiments of the invention. FIG. 8A shows a side view, and the 1/16 inch (approx. 1.59 mm) ID pivot hole near the top, lower towards the middle on the back is the molded 0.050 mm threaded horizontal tube/mount 169 in which the 0.050 mm thread weight/balance/setscrew is inserted. Also shown toward the bottom of FIG. 8A are the five 0.010 inch (approx. 0.25 mm) center holes formed through the pendulum and spaced 1/16 inch (approx. 1.59 mm) apart from center to center (which align with the five final mounting holes of the fiber optic light guides of the apparatus when it is at true vertical or at a preset offset). FIG. 8B shows the front view of the pendulum, the lower half shows the different color patterns that will be transmitted to the pin as the light path through the pendulum moves left or right relative to the pendulum due to tilt. FIG. 8C shows the back view of the pendulum and, approximately in the middle, the 0.050 mm thread horizontal tube/mount that receives the 0.050 mm threaded weight/balance/setscrew.

Figure 9A:
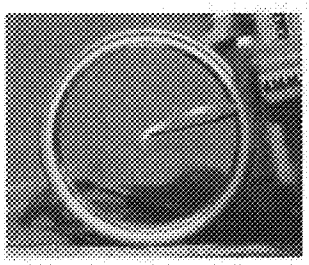
FIGS. 9A-E show a series of photographs of a single pin bow sight operably connected to a vertical levelness-indicating device prototype of the invention for mounting on a bow, each of the photographs showing the optical signal output of the sight pin at the different axial offsets shown in the respective figures.
Figure 9B:
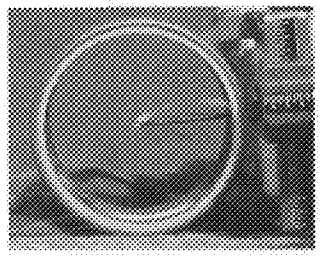
Figure 9C:
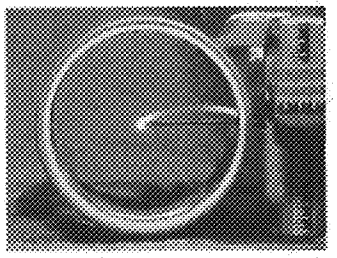
Figure 9D:
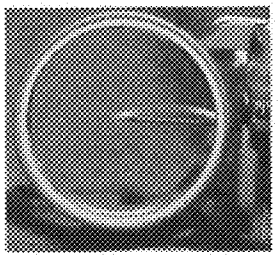
Figure 9E:
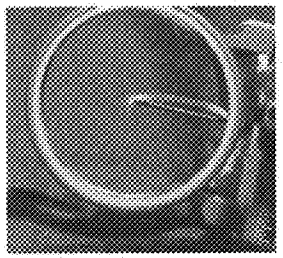

FIGS. 9A-E show a series of photographs (black and white) of a single pin bow sight (from the archer's perspective) operably connected to a verticalness-indicating device prototype of the invention mounted on a bow, each of the photographs showing the optical signal output of the sight pin at the different axial offsets of the bow shown in the respective figures. The prototype indicator pendulum used was configured and oriented in the manner shown in FIGS. 8B and 8C and the prior figures. FIGS. 9A-E are presented in such a manner that the support arm of the sight pin when horizontally level indicates that the bow is vertical with axial tilts similarly indicated. FIG. 9C shows the bright white light output of the sight pin when the bow is perfectly vertical (i.e., "level" in the parlance of the art since verticalness has conventionally been measured by a horizontally mounted bubble level). FIG. 9B shows the green filtered light output of the pin sight when the bow is slightly tilted counterclockwise and FIG. 9A shows the purple filtered light output when the bow is tilted even further counterclockwise. FIG. 9D shows the red filtered light output of the pin sight when the bow is slightly tilted clockwise and FIG. 9E shows the purple light output when the bow is tilted even further clockwise.

Operation of the Device

In one embodiment, a multi-color optical filter pendulum is encased in a small housing, which is preferably opaque, and mounted to the bow sight, integrated with the bow sight or mounted to the bow. Inside the housing, the pendulum is disposed between the proximal end of the fiber optic light guide (which delivers light to the pin) and a light source such as a prism, a reflective surface such as a mirror or a powered light, such as an LED light. The light guide may be encased in an opaque sheath (tube, cladding etc.) to prevent environmental light, such as sunlight or light from camera flash bulbs, from entering the system and being inadvertently delivered to the pin. In this manner, at least predominantly, for example only, light originating from the light source that has passed through the pendulum is delivered to the pin.

When the bow is at true vertical (perpendicular to true level in the horizontal axis), gravity will align a 0.010 inch (approx. 0.25 mm) hole in the pendulum with the light source transmitting a higher intensity white light (or whichever color light source the archer has chosen to supply light to the pin) directly through the light guide, transmitting this light directly to the pin, thereby indicating to the archer that the bow has achieved true vertical.

With respect to the configuration of the embodiments shown in the figures, as the top of the bow tilts slightly to the left (the bow rotates slightly counterclockwise, from the perspective of the archer), gravity maintains the pendulum of the embodiment in a vertical (plum) orientation while the light path from the light source to the receiving (proximal) end of the light guide is moved right-of-center with respect to the midline of the pendulum, partially covering the light source which projects the less intensity white, then pale green color through the multi colored pendulum and transmits a slightly diminished pale green color through the light guide to the pin. These color changes are virtually instantaneously transmitted to the pin so that the archer can, incrementally, correct the tilt of the bow, back to vertical (level), which is indicated by a brightly illuminated white pin. The further out of vertical (level) the bow is tilted counterclockwise, the deeper the green color becomes, until finally, the pin becomes dark purple which signifies that the bow is completely out of vertical (level) and should not be shot.

With further respect to the configuration of the embodiments shown in the figures, as the top of the bow tilts slightly to the right (the bow rotates clockwise from vertical, from the perspective of the archer), gravity keeps the pendulum of the embodiment in a vertical (plumb) orientation while the light path from the light source to the receiving (proximal) end of the light guide is moved left-of-center with respect to the midline of the pendulum. Progressively tilting the bow clockwise first partially covers the light source which projects the less intensity white, then reddish pink color through the multi colored pendulum and transmits a slightly diminished white pink reddish color through the fiber optic material to the pin. These color changes are virtually instantaneously transmitted to the pin so that the archer can incrementally correct the tilt of the bow back to vertical (level), which is signified by the brightly illuminated white pin. The further out of vertical the bow is tilted clockwise, the deeper the red color becomes, until finally, the pin becomes dark purple (the light path passes through the purple filter portion) which signifies that the bow is completely out of vertical (level) and should not be shot.

While the embodiments exemplified herein have been presented with a particular front and back side orientation of the device with respect to the archer's position, i.e., with respect to the draw side and launch side of the bow, it should be readily understood that a verticalness-indicating device as a whole or just the indicator pendulum of the device may be mounted on a bow (or other projectile launching apparatus) in a reverse orientation. For example, with the device as a whole or its indicator pendulum mounted in a reverse orientation to that shown in the figures, from the archer's perspective, a clockwise tilt will cause a green signal and a counterclockwise tilt will cause a red signal.

The aforementioned colors have been found to be well-adapted for a single pin application. However, the invention provides that the color scheme of the pendulum can be selected and/or changed to accommodate various archers' preferences and/or requirements. Also, for a multiple pin sight, different colored fiber optic material or color filters placed in the path of the light guide(s), such as at one end or another, may be used to colorize preset pins in a descending height pattern previously aligned by the archer, to hit the center of further distance targets. Thus, the brightly illuminated white colored pin may be substituted for a more desirable color that is similarly affected by the pendulum's color shifting filter areas and light transmitting through-hole(s). Although the invention is readily implementable for any preference of colors, in the multi-pin application, primary colors may be used as they are extremely noticeable when instantaneously transmitted to the pin.

The light transmission controlling pendulums of the invention may be formed from any suitable material or combination of materials. The pendulums may, for example be formed from a synthetic polymer. For example, the pendulums may be stamped or cut from a sheet of transparent synthetic polymer such as Polyethylene terephthalate (PET), for example, 0.2 mm to 1.0 mm thick, such as 0.2 mm to 0.6 thick. The pendulums may, for example, also be molded from or machined from Poly(methyl methacrylate), i.e., acrylic. When the pendulum is formed from a clear transparent material, the various color filter areas and any opaque delineation lines may, for example, literally be applied using color markers or similar industrial scale versions thereof, as used in the preparation of the prototypes of the invention. Alternatively, color filter areas may be applied to the transparent pendulum members in the form of color filtering polymer films as known in the art, for example, adhered to the body of the pendulum using transparent adhesive. For embodiments in which the pendulum has one or more through-holes for the transmission of light, the through-holes may, for example, be formed by drilling or punching, or as part of a molding process. A top hole in the pendulum for pivotal attachment to a rod or similar member may, for example, be formed in the same ways. The pendulum may, for example, also be formed from a metal or synthetic polymer expansive frame member that has one or more expansive openings transverse to the plane of the pendulum formed in it and one or more expansive color filters and/or clear members that are sized and configured to securably fit into (such as click/snap into) the expansive opening in the expansive frame member to form an operable light controlling pendulum assembly.

Embodiments of the invention involving multi-pin sights also benefit beginner and inexperienced archers who are often confused, especially under pressure, as to which pin to use at what distance. Thus, embodiments in which a pin selector that has one hole formed through it for the light to pass (or similarly one transparent portion for the light to pass) and blocks out light to all the other pins except the pin that has been selected for a predetermined yardage/distance desired eliminates the possibility that one pin may be confused for another during aiming.

Light Sources

A prism or reflective surface, such as a mirror, may be used to collect ambient, natural light and shunt it to the pendulum for use. An unshielded optical fiber or optical fiber bundle, for example, configured as a coil on the outside of the apparatus, may also be used as the light source collecting ambient light and delivering it into the device. Also a rheostat LED light source, such as those commercially available with a thread size of ⅜ inch×32 (approx. 9.54 mm major diameter, 32 threads per approx. 25.4 mm) may be used and adjusted to whatever light intensity the archer desires.

Pendulum Weight/Set Screw

As the pendulum hangs from its pivot point, its center of mass (center of gravity) will always be disposed immediately vertically below the pivot point. The line connecting the pivot point to the pendulum's center of mass is referred to as the "plumb line" herein. For embodiments of the invention in which the pendulum has a through-hole (or special clear or color filter area) that aligns with the light path when the bow is at true vertical, the through-hole (or special clear or color filter area) is positioned on the plumb line. Some archers, however, prefer to operate their bow at an axial off-set versus true vertical. The verticalness indicating apparatus of the invention may include and be preset via a set screw/weight so that the plumb line passes through the light path when the bow is exactly vertical (plumb). The set screw may also be adjusted to that the through-hole (or special filter) area is aligned with the light path when the bow is at a selected axial off-set to true vertical. In one embodiment, the set screw may, for example, be accessed and adjusted via an access port formed in the housing of the apparatus and sealed with a removable plug when not in use. Once the plug is removed, an Allen key/tool can be inserted into the Allen set screw/weight. By threading the Allen setscrew/weight in or out (by turning the tool), the center of gravity of the pendulum can be shifted to the left or right, so that the pendulum can be centered to any archer's desired offset or bow canter. For example, a particular archer may prefer to shoot when their bow is tilted two-degrees clockwise and the set-screw may adjusted so that the through-hole (or special clear or color filter area) of the pendulum is exactly aligned with the light path from the light source to the proximal end of the light guide when the bow is tilted at this off-set, rather than at true vertical.

The O-Ring

In order for the inside components to be protected from the outside elements, a 1⅞ inch (approx. 4.76 cm) O-ring gasket/seal is placed between the front and back housing sections described herein, so that it sits inside the recessed front half of the box housing. The O-ring creates a water tight seal. The position of the O-ring is indicated in FIG. 2 by an arrow. Those skilled in the art will appreciate that many sizes, shapes and configurations of housings as well as manners of sealing such housings may be used and while one has been exemplified in the figures many are possible and the invention is not limited to any particular design of housing or seal. The invention also provides corresponding embodiments that lack a housing or lack a full housing or enclosure.

Figure 10:
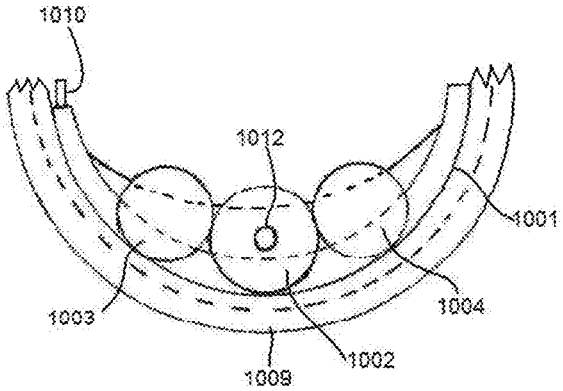
FIG. 10 shows an embodiment of the invention that relies on rolling, cylindrical light transmission controlling members to control light transmission in relation to the tilt of the apparatus.

FIG. 10 shows an embodiment of the invention that relies on a system of rolling cylindrical, such as disc-shaped, light transmission controlling members, such as optical filters, to control light transmission rather than a pendulum. The other components of the apparatus may be the same as in the pendulum-based embodiments. The embodiment includes a curved support track 1001 on which three cylindrical filters are disposed, a middle green filter 1002 that has a central through-hole 1012 formed therein, a yellow filter 1003 to the left (as shown) that does not include a through-hole, and a red filter 1004 to the right (as shown) that also does not include a through-hole. When the bow on which the apparatus and archery sight are mounted is at true vertical, through-hole 1012 is aligned with the light path between the light source and the proximal end of the light guide that is operably connected with the pin sight of the sight, giving a bright unfiltered light indication of verticalness to the archer. As the bow is tilted slightly in either direction, the light is filtered green by middle filter 1002. If the bow is tilted counterclockwise (from the perspective shown), after green filter 1002, red filter 1004 will roll into the light path. If the bow is tilted clockwise (from the perspective shown), after green filter 1002, yellow filter 1003 will roll into the light path. Support track 1001 is pivotally mounted in/on a cradle member 1009 so that its dwell angle may be adjusted by an adjustment screw 1010 to permit archers who prefer to shoot at an axial offset to true vertical to adjust the apparatus so that the through-hole will be aligned with the light path at their preferred axial off-set. Alternatively, support track 1001 could be pivotally supported by an axle. Support track 1001 may, for example, be machined from aluminum. The cylindrical filter members may, for example, be formed from glass or acrylic polymer. Commercially available cylindrical optical filters may be used directly or as stock to manufacture the filter members of the embodiment. In one variation, the mechanism shown in FIG. 10 may be incorporated into a housing with the remaining parts of the apparatus the same as or similar to the pendulum-based embodiments described herein. In another variation, the rolling filter embodiment may be directly integrated into the pin surround member of a sight.

Figure 11:
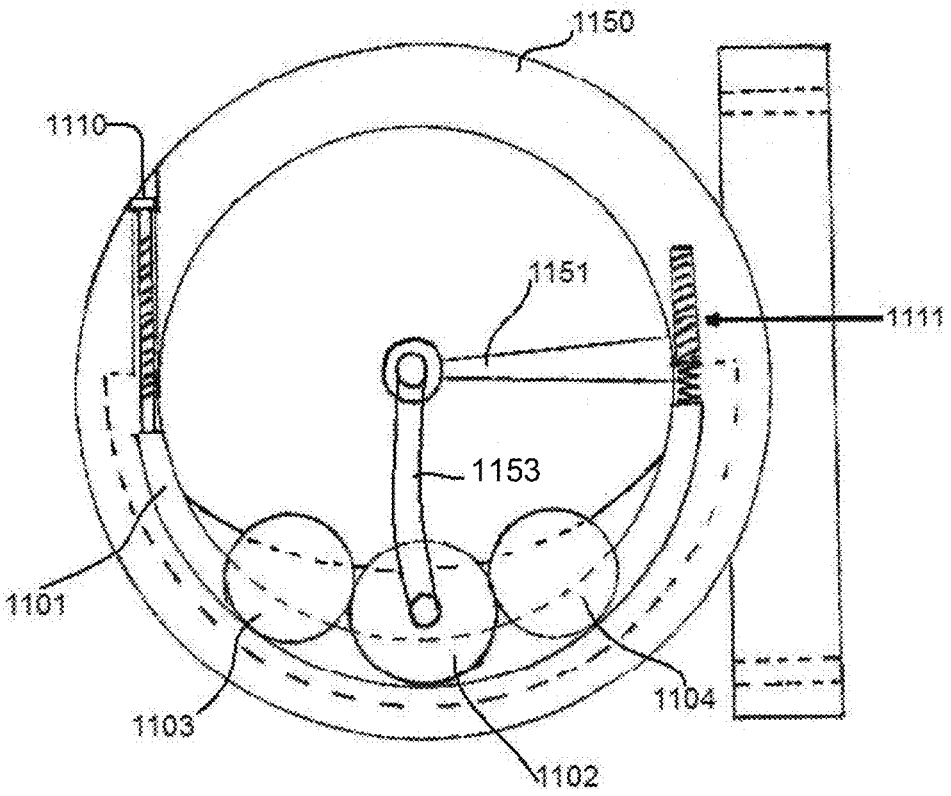
FIG. 11 shows an archery sight embodiment of the invention in which the verticalness indicating mechanism of FIG. 10 is directly incorporated into the sight.

FIG. 11 shows an archery sight embodiment of the invention in which the verticalness indicating mechanism of FIG. 10 is directly incorporated into the archery sight. Common features between FIGS. 10 and 11 are similarly numbered. In FIG. 11, the pin guard 1150 is configured to act as the cradle support for support track 1101 for rolling, light transmission controlling members 1102-1104. Adjustment screw 1110 is provided to adjust the dwell angle of support track 1101 and spring 1111 is provided at the opposite end of the support track to provide resistance. Light guide 1153 which may include an optical fiber or optical fiber bundle is in optical communication with sight pin 1151. Light guide 1153 is only schematically shown as separately entering (with respect to pin sight 1151) the area bounded by pin guard 1150 for ease of illustration. In practice, it is preferred that the light guide at least substantially conforms to or follows the perimeter of the pin guard and then extends through the arm of the sight pin to its terminal portion. In this manner, the light guide does not unnecessarily obstruct the area bounded by the pin guard. As with the other embodiments, the transmission of light from a light source to light guide 1153, and ultimately to the terminal portion of the pin sight, is controlled by the interposed cylindrical light transmission controlling members 1102-1104.

Although the invention has been described in connection with specific preferred embodiments within, it should be understood that the invention as claimed should not be unduly limited to the specific embodiments described. Indeed, various modifications of the described modes for carrying out the invention which are obvious to those skilled in the art are intended to be within the scope of the following claims.

What is claimed is:

1. A verticalness indicating apparatus, comprising:

a back side, a front side, a left side and a right side a pendulum member having a back side, a front side, and an expansive dimension in a plane transverse to a front-back direction, the pendulum pivotally suspended in a left-right direction;

a light source disposed on the front side or the back side of the pendulum;

a light guide having a proximal end and a distal end, the proximal end of the light guide disposed on the opposite side of the pendulum as the light source, the pendulum being interposed between the light source and the proximal end of the light guide, wherein the position of the light source and the position of the proximal end of the light guide are static with respect to each other, wherein a through-hole is formed from the back side to the front side of the pendulum, the through-hole sized and disposed in the pendulum so that it aligns with the proximal end of the light guide when the apparatus is in an at least substantially zero-degree or pre-set tilt from vertical orientation, and wherein the pendulum comprises at least one color filter area to the left of the through-hole and at least one color filter area to the right of the through-hole, whereby the pendulum is configured to control one or both of the amount of light and the color of light received into the proximal end of the light guide after originating from the light source based on the axial tilt of the apparatus in the plane transverse to the front back direction.

2. The verticalness indicating apparatus of claim 1, wherein a color filter area to the left of and nearest the through-hole is a different color than a color filter area to the right of and nearest the through-hole.

3. The verticalness indicting apparatus of claim 1, wherein the pendulum comprises an adjustable balance weight.

4. The verticalness indicating apparatus of claim 1, wherein the light guide is elongate.

5. The verticalness indicting apparatus of claim 4, wherein the light guide comprises one or more optical fibers.

6. The verticalness indicating apparatus of claim 5, wherein the light source comprises a light-emitting diode.

7. An assemblage comprising:

the verticalness indicating apparatus of claim 1; and an aiming sight comprising a pin guard defining an inner perimeter surrounding a space and a sight pin extending into the space, wherein the distal end of the light guide is in optical communication with the sight pin.

8. The assemblage of claim 7, further comprising:

a bow, wherein the vertical indicating apparatus and the aiming sight are individually mounted to the bow or mounted to the bow as a unit comprising the vertical indicating apparatus and the aiming sight.

9. A verticalness indicating apparatus, comprising:

a back side, a front side, a left side and a right side;

a pendulum member having a back side, a front side, and an expansive dimension in a plane transverse to a front-back direction, the pendulum pivotally suspended in a left-right direction;

a light source disposed on the front side or the back side of the pendulum;

a plurality of linearly aligned, vertically separated light guides each having a proximal end and a distal end, the proximal end of each light guide disposed on the opposite side of the pendulum as the light source, the pendulum being interposed between the light source and the proximal ends of the light guides, a movable selector member sized and configured to permit light from the light source to pass at least substantially only into the proximal end of a selected one of the plurality of linearly aligned, vertically separated light guides, wherein the position of the light source and the position of the proximal end of the light guide are static with respect to each other, wherein for at least one of the plurality of light guides, a through-hole is formed from the back side to the front side of the pendulum, the through-hole sized and disposed in the pendulum so that it aligns with the proximal end of the light guide when the apparatus is at an at least substantially zero-degree tilt vertical orientation or a preset non-zero degree tilt orientation, and wherein the pendulum comprises at least one color filter area to the left of the through-hole and at least one color filter area to the right of the through-hole, whereby the pendulum is configured to control one or both of the amount of light and the color of light received into the proximal end of the selected light guide after originating from the light source based on the axial tilt of the apparatus in the plane transverse to the front back direction.

10. An assemblage comprising:

the verticalness indicating apparatus of claim 9; and an aiming sight comprising a pin guard defining an inner perimeter surrounding a space and a plurality of sight pins extending into the space, wherein the distal end of each of at least two of the light guides is in optical communication with a separate sight pin of the plurality of sight pins.

11. The assemblage of claim 10, further comprising:

a bow, wherein the verticalness indicating apparatus and the aiming sight are individually mounted to the bow or mounted to the bow as a unit comprising the vertical indicating apparatus and the aiming sight.

12. A verticalness indicating apparatus, comprising:

a back side, a front side, a left side and a right side a pendulum member having a back side, a front side, and an expansive dimension in a plane transverse to a front-back direction, the pendulum pivotally suspended in a left-right direction;

a light source disposed on the front side or the back side of the pendulum;

a light guide having a proximal end and a distal end, the proximal end of the light guide disposed on the opposite side of the pendulum as the light source, the pendulum being interposed between the light source and the proximal end of the light guide, wherein the position of the light source and the position of the proximal end of the light guide are static with respect to each other, wherein the pendulum has a plumb line and the pendulum comprises at least one color filter area to the left of the plumb line and at least one color filter area to the right of the plumb line, and wherein a color filter area to the left of and nearest the plumb line is a different color than a color filter area to the right of and nearest the plumb line, whereby the pendulum is configured to control the color of light received into the proximal end of the light guide after originating from the light source based on the axial tilt of the apparatus in the plane transverse to the front back direction.

13. A verticalness indicating apparatus, comprising:

a back side, a front side, a left side and a right side a light transmission controlling member having a back side, a front side, and an expansive dimension in a plane transverse to a front-back direction, the light transmission controlling member movable in a left-right direction in relation to the axial tilt of the apparatus in plane transverse to the front back direction;

a light source disposed on the front side or the back side of the light transmission controlling member;

a light guide having a proximal end and a distal end, the proximal end of the light guide disposed on the opposite side of the light transmission controlling member as the light source, the light controlling member being interposed between the light source and the proximal end of the light guide, wherein the position of the light source and the position of the proximal end of the light guide are static with respect to each other, wherein a through-hole is formed from the back side to the front side of the light controlling member, the through-hole sized and disposed in the light controlling member so that it aligns with the proximal end of the light guide when the apparatus is in an at least substantially zero-degree or pre-set tilt from vertical orientation, and wherein the light controlling member comprises at least one color filter area to the left of the through-hole and at least one color filter area to the right of the through-hole, whereby the light transmission controlling member is configured to control one or both of the amount of light and the color of light received into the proximal end of the light guide after originating from the light source based on the axial tilt of the apparatus in the plane transverse to the front back direction.

14. An assemblage comprising:

the verticalness indicating apparatus of claim 13;

an aiming sight comprising a pin guard defining an inner perimeter surrounding a space and a sight pin extending into the space, wherein the distal end of the light guide is in optical communication with the sight pin; and a bow, wherein the vertical indicating apparatus and the aiming sight are individually mounted to the bow or mounted to the bow as a unit comprising the verticalness indicating apparatus and the aiming sight.

* * * * *